United States Patent [19]

Novy et al.

[11] 4,160,680

[45] Jul. 10, 1979

[54] VACUUM CARBURIZING

[75] Inventors: Russell F. Novy, Northbrook; Gerald L. Scott, Glenview; Thomas O. Zurfluh, Chicago, all of Ill.

[73] Assignee: Sola Basic Industries, Inc., Milwaukee, Wis.

[21] Appl. No.: 897,414

[22] Filed: Apr. 18, 1978

Related U.S. Application Data

[63] Continuation of Ser. No. 739,105, Nov. 5, 1976, abandoned, which is a continuation of Ser. No. 553,594, Feb. 27, 1975, abandoned.

[51] Int. Cl.[2] ..... C21D 1/06

[52] U.S. Cl. ..... 148/16.5; 148/16.6

[58] Field of Search ..... 148/14, 16, 16.5, 16.6; 266/250

[56] References Cited

U.S. PATENT DOCUMENTS

| | | | |
|---|---|---|---|
| 2,565,360 | 8/1951 | Dufilho | 148/16.6 |
| 3,168,607 | 2/1968 | Greene | 148/20.3 |
| 3,171,759 | 3/1965 | Glenn | 148/16 |
| 3,519,257 | 7/1970 | Winter et al. | 148/16.5 |
| 3,565,410 | 2/1971 | Scherff | 266/250 |
| 3,796,615 | 3/1974 | Westeren et al. | 148/16.5 |
| 3,853,637 | 12/1974 | Gray et al. | 148/20.3 |

FOREIGN PATENT DOCUMENTS

| | | | |
|---|---|---|---|
| 692161 | 8/1964 | Canada | 148/16.5 |

OTHER PUBLICATIONS

Iron Age, vol. 208, #9, 8/26/71.

*Primary Examiner*—Arthur J. Steiner

*Attorney, Agent, or Firm*—Parmelee, Johnson, Bollinger & Bramblett

[57] ABSTRACT

A vacuum furnace is provided with subatmospheric pressure control of a diffusable media and with a fan at an end of a heated load chamber to circulate uniformly the diffusable media around the workpieces which are contained within the load chamber.

11 Claims, 6 Drawing Figures

TYPICAL ILLUSTRATIVE EXAMPLE OF SUBATMOSPHERIC GASEOUS(SAG)CARBURIZING.

VACUUM CARBURIZING

RELATED APPLICATIONS

The present application is a continuation of copending application Ser. No. 739,105, filed Nov. 5, 1976 (now abandoned), which in turn is a continuation of its copending application Ser. No. 553,594, filed Feb. 27, 1975, and now abandoned.

The present invention relates to subatmospheric gaseous carburizing and, more particularly, to an apparatus and method for circulating uniformly the carbon-containing material around the workpieces. Related subatmospheric gaseous processes are carbonitriding and nitriding. The term or abbreviation "SAG" when used herein means "subatmospheric gaseous."

Carburizing, which is the introduction of additional carbon to the surface of a steel part, has been known for many years and has been practiced to improve the wear resistance of a steel part or workpiece.

In early practice, open charcoal pits and box carburizing were used. Bone meal was packed around the parts to provide a protective atmosphere when heated and to be the source of carbon. In such processes, however, there were many problems including quality control. Next, gaseous carburizing was developed, such as wherein an endothermic gas is used, produced by cracking material or propane gas, to displace the air in a furnace chamber. By controlling dewpoint of the gas, a relationship was found between the carbon level of the steel and the gas composition (which is related to the dew point through the water-gas reaction) which, if controlled properly, would not add or remove carbon from the steel. Since this point of equilibrium is temperature sensitive, it has been common practice to control the endothermic gas carbon potential (dew point or $CO_2$ level) at the furnace operating temperature set point where the parts were soaked out.

In an atmosphere gas carburizing furnace, the source of carbon for adding carbon to the steel is commonly either natural gas, propane gas or butane gas added to the endothermic atmosphere. The natural gas may be primarily methane with up to 1% oxygen, up to 2% carbon dioxide and up to 15% higher hydrocarbons. Higher percentages of raw gas additions may result in sooting the work which will tend to retard carburizing. In a normal atmosphere gas carburizing cycle, the maximum surface carbon is usually held to 120 point (1.2%) carbon or less. From the surface inward, the percentages of carbon are reduced until the original carbon level of the steel is reached. This distance or thickness of carbon enrichment is referred to as "total case." The effective case is measured to the point where 40–50 points (0.40–0.50%) of carbon are present or, if the part is hardened, to a Rockwell "C" scale hardness level of 50. Since 120 points of carbon on the surface is normally too high for general metallurgical applications, a carbon diffusion time is allowed during the cycle. This is accomplished by reducing the raw gas additions to a point at which the furnace atmosphere is in equilibrium with the desired surface carbon percentage. During this part of the cycle, surface carbon is diffused into the workpiece and also lost to the furnace atmosphere. If the furnace is not controlled properly, this results in a carburized layer that has less carbon on the surface than at the 0.002"–0.005" depth level. Early gas carburizing furnaces were built with only through-put gas circulation. Because the process is a gas to metal surface reaction, stagnate areas in the hot zone would result in uneven cases and limit the density of allowable workpiece packing.

In vacuum carburizing, such as seen in Canadian Pat. No. 692,161, or U.S. Pat. No. 3,796,615, the chamber in which the carburizing process is to be conducted is evacuated, and this serves to keep oxygen away from the heated steel workpiece within the chamber. The workpiece is then heated, and a carburizing agent is supplied by a partial pressure backfill of natural gas or propane gas. However, because of the stratification of the relatively still gas in the chamber, the workpieces within the chamber were nonuniformly carburized, particularly when the workpieces were closely packed. Other arrangements were then proposed to stream the gas over the workpieces, but they were found to be not feasible, since in practice, the many arrangements of diverse workpieces did not enable the gas to be streamed uniformly through the workpiece loadings.

Industrial carburizing must be performed at a minimun cost per pound and with maximum repeatability and uniformity. Usually the workpieces are packed as densely as possible without preventing the carburizing gas from reaching all surfaces.

Carburizing is a temperature dependent process, both carburizing and diffusion rates accelerating as a direct function of temperature. However, in many applications, increased temperature could be detrimental because such will result in:

(a) Rapidly increased workpiece grain growth with low physical properties
(b) Rapidly increased wear and deterioration of the furnace interior and increased energy consumption
(c) Increased deterioration of furnace load fixtures and baskets One of the objects of the invention is to provide an improved apparatus and process for SAG carburizing of a workpiece.

Another of the objects of the invention is to provide an apparatus and process for the uniform circulation of gases within the chamber through the workpieces during the SAG process.

Another of the objects of the invention is to increase the speed of carburizing, carbonitriding and nitriding and to provide improved control thereof.

It has been found that both carburizing and carbonitriding are fast, commercially feasible processes when performed in a subatmospheric pressure environment. The processes are reliable, reproducible and accurately controllable and eliminate the need for atmosphere generating equipment and sophisticated measurement and control systems. A vacuum furnace is immediately ready to process without warm-up or conditioning and can switch from carburizing to neutral hardening, brazing, or annealing with special conditioning or furnace modification.

Inasmuch as no smoke, heat or fumes enter the room air, operator comfort and efficiency are increased, the furnace can be used in an air-conditioned area, and the furnace can be integrated directly with a production line. Such eliminates work transfer to and from a specialized heat treating area, parts do not get lost and heat treating personnel do not become isolated from the production work team.

The evacuation of the room air from the furnace chamber while the work zone and the parts are at room temperature removes most of the air and water vapor even from blind holes and densely packed loads. Conventional atmosphere purging allows residual air and water vapor to be carried from the purge chamber into the furnace chamber, disrupting the atmosphere equilibrium.

During heating in a vacuum, the residual air and water vapor adhering to the parts and heating zone walls are driven off and pumped out of the chamber. In conventional atmosphere furnaces, these contaminants mix with the incoming atmosphere but are purged out less efficiently by the atmosphere flow. At a vacuum level of 0.1 torr (the equivalent of a −40° F. dew point), the partial pressures of residual reactive gases, such as oxygen, water vapor, carbon dioxide, carbon monoxide, and hydrogen, are so small that no decarburization of the parts occurs. Conventional atmosphere furnaces often decarburize the surface of parts before reaching the soak temperature at which carburizing additions are made. In the vacuum furnace, the vapor pressure of carbon is sufficiently low so that carbon will not escape from a steel surface even at 1900° F. Thus, the parts in the vacuum furnace are continuously cleaned and protected from room temperature to the carburizing temperature.

The vacuum furnace can be held at the carburizing temperature as long as desired to guarantee that all areas of the load are at the same temperature before beginning the carburizing additions without carburizing or decarburizing since the vacuum has no carbon to give up and the carbon in the steel can not escape. In an endothermic atmosphere, expensive controls are necessary to balance the atmosphere to prevent each area of the load from starting to carburize or decarburize as its temperature reaches the carburizing range. The danger of decarburizing or premature carburizing exists throughout the preheat cycle in endothermic atmosphere.

If the parts are heavily discolored, rusted, or surface contaminated, a 1 to 5 torr partial pressure of hydrogen can be added during the temperature uniformity soak to chemically reduce the oxides. While a vacuum environment will allow most of the iron oxide to disassociate, hydrogen reduction speeds the removal process.

When the load is at a uniform temperature, the carburizing gases are backfilled into the vacuum and will immediately contact all surfaces equally, even the blind holes. Carburizing begins immediately, an important consideration in light case specifications. An endothermic atmosphere must reach into closely packed loads and blind holes by circulation and diffusion, resulting in different initial rates of carburizing in different areas.

After introduction of the carburizing gas or material, the subatmospheric pressure gas needs fan circulation to keep fresh carburizing gas adjacent to the part surfaces in the dense loads necessary for high productivity.

In the carburizing cycle of vacuum furnace processing, the carbon potential in the carburizing gas is very high since no diluting gas, such as nitrogen, is present. If endothermic atmosphere is used at carbon potentials above 1.20% carbon, sooting may occur which will block or retard further carburizing. The SAG carburizing potentials exceed 1.50% carbon during the carburizing cycle. Light sooting also occurs in the vacuum furnace if the temperature is less than 1825° F., but such does not retard the carburization. Since the vacuum furnace operates at a higher carbon potential than the endothermic atmosphere furnace, the carbon moves into the steel faster in the SAG process. This means that the vacuum case depths are deeper for the same time at the same temperature, or conversely that SAG processing can obtain a specified case depth in less time than an endothermic atmosphere furnace at the same temperature.

To lower the surface carbon level from the high carburizing level to the desired value, usually 0.80% to 1.10% carbon, the carburizing cycle is followed by a diffusion cycle. In an endothermic atmosphere furnace, the diffusion cycle consists of lowering the carbon potential of the atmosphere below the carbon potential of the surface, thereby pulling carbon out of the surface, as well as letting some of the carbon in the carburized case move deeper into the core of the part. In the vacuum furnace, the process is entirely different.

At the end of the carburizing cycle in a vacuum furnace, the carburizing gas is pumped out of the furnace. This gives the same condition that existed during the temperature stabilization period. That is, the reactive gases have been removed, and the carbon can not escape due to its low vapor pressure. Therefore, all of the carbon driven into the surface of the steel during the carburizing cycle must move deeper into the steel core. The light surface film of carbon also diffuses inward. Since the movement is all inward, the rate of movement of carbon toward the core is faster in a subatmospheric pressure gas than in an endothermic atmosphere at the same temperature during the diffusion cycle.

At the end of the diffusion cycle, the load may be slow cooled for later reheating and quenching, or may be directly gas fan cooled or directly oil quenched. Alternatively, the temperature may be lowered, the load stabilized at the lower temperature, and then oil quenched. For grain refinement after a 1900° F. carburizing cycle, the load may be pulled to the vestibule of the furnace for gas quenching below the critical temperature of the steel, then reheated to the austenitizing temperature and oil quenched. The quenching processes are the same as those of an atmosphere furnace.

The resulting microstructures have been found to be equal to or better than endothermic atmosphere processes and are free of such surface phenomena as grain boundary oxidation.

According to one aspect of the invention, the SAG carburizing furnace may comprise means defining a load chamber into which workpieces or metallic articles to be carburized can be introduced, the load chamber having heating element means associated therewith. A vacuum chamber encloses the heating element means and the load chamber means. Means are provided to evacuate the vacuum chamber and then to introduce into the vacuum chamber a carburizing gas or material. Means are provided for positively circulating uniformly the heated carburizing gas around the workpieces.

The process according to the present invention for carburizing a metallic workpiece in the vacuum chamber may comprise the steps of evacuating the chamber to a partial vacuum, heating the workpieces therein, and then introducing a carburizing gas or material into the chamber. There is established within the chamber a temperature at which the carbon combines with the workpiece, and this temperature is maintained for a predetermined period. The carburizing gas is circulated uniformly around the workpiece during the carburizing cycle without cooling thereof.

Other objects, advantages and features of the present invention will become apparent from the accompanying description and drawings, which are merely exemplary.

In the drawings.

Proceeding next to the drawings wherein like reference symbols indicate the same parts throughout the various views, a specific embodiment of the present invention will be described in detail.

Figure 1:
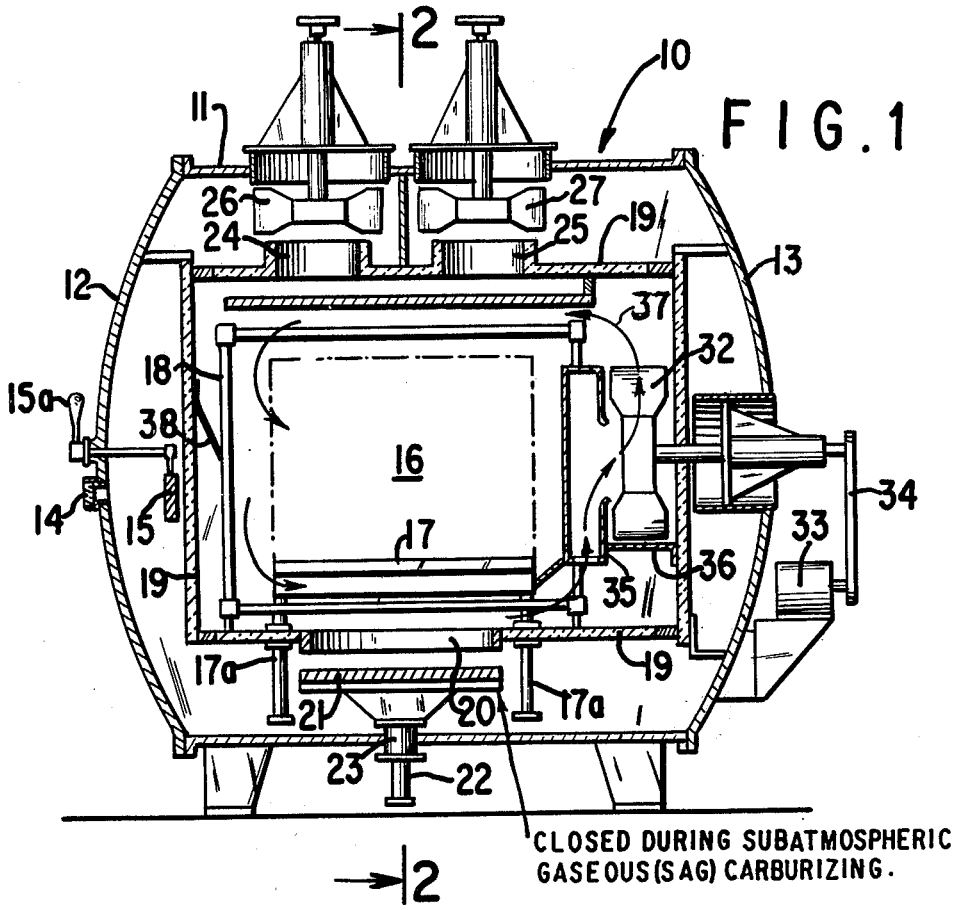
FIG. 1 is a longitudinal vertical sectional view through a subatmospheric gaseous (SAG) carburizing furnace according to the present invention.
Figure 2:
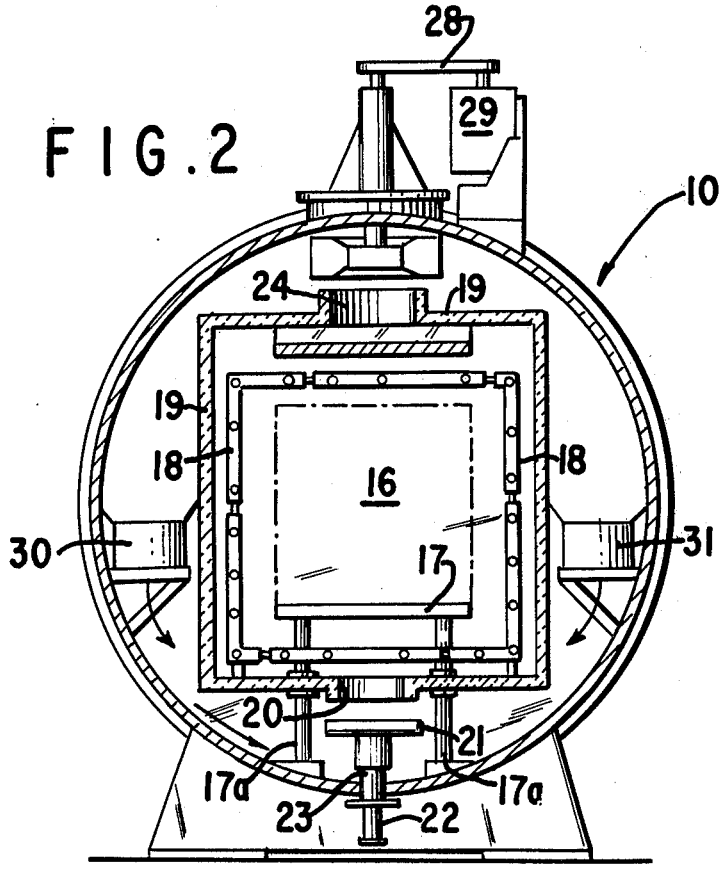
FIG. 2 is a sectional view taken along the line 2—2 of FIG. 1.

As can be seen in FIGS. 1 and 2, the SAG carburizing furnace of the present invention is indicated generally at 10 and comprises a substantially cylindrically-shaped vacuum chamber 11, having a door 12 on one end. The other end may also have a door 13 or access means to provide access to the hot circulating fan or circulating means which is to be presently described. The door 12 is provided with a sight glass 14 and an insulating cover 15 pivotally mounted therein and pivotable by means of a handle 15*a* accessible on the exterior of the door.

Within the vacuum chamber 11, there is provided a load chamber 16 which is essentially the space above the work handling grid or platform 17 mounted on vertical supporting rods 17*a*.

Electrical resistance heating elements are indicated at 18 and are positioned to completely surround the load 16 in a longitudinal direction. Other types of heating elements can be used.

Enclosing the heating elements is insulation means 19. The lower surface of the insulation is provided with an opening 20 which can be selectively closed by means of closure member 21 supported upon an air cylinder 22 which enters the vacuum chamber through a vacuum seal 23.

In the upper wall of the insulation, there are provided openings 24 and 25 above which are mounted conventional cooling fans 26 and 27 which are belt driven at 28 through drive motor 29. Water cooled fin and tube heat exchangers are provided at 30 and 31 through which the cooling gases are circulated as they pass around the insulation so as to remove heat therefrom and cool the outside wall of the vacuum chamber.

To provide for uniform circulation of the carbon containing material through the load chamber within which may be positioned many workpieces, fan 32, which may be termed the "hot fan" is provided at the end of the load chamber away from access door 12. Fan 32 is driven by a motor 33 through belt 34. A shroud 35 is provided between the fan 32 and the load chamber 16 to guide the gases into the fan. Shroud 36 encloses the fan and discharges the gases upwardly therefrom as indicated by the solid arrows 37. The arrows 37 show that the heated gases within the vacuum chamber are moved within the area defined by the heating elements and are introduced at the end of the load chamber adjacent the door 12 by means of suitable deflector baffles 38.

In order to carry out the carburizing process, the load consisting of the workpieces to be carburized is introduced into the load chamber. This can be accomplished by means of the platform 17 which is removable by a fork lift truck so that the grid can be properly loaded outside of the vacuum chamber.

In one example, the vacuum chamber is evacuated to a pressure of approximately 0.050 to 0.100 torr by means of a vacuum pump, which for purposes of clarity is not shown in the drawings, but is known in the art. The work load is then heated by means of electrical heating elements 18 to the carburizing temperature which might be in the range of 1650° F. to 2000° F. The gases emitted from the workpieces are evacuated so that the atmosphere of the furnace is approximately 0.1 torr. The carburizing is then carried out by partial backfilling with a suitable gas and by the forced circulation of the carburizing atmosphere using the hot fan. The vacuum valve is closed, the heat maintained and the carburizing agent introduced. The carburizing atmosphere is about 50 to 500 torr. If needed, inert gases can be used to dilute the gas. The carburizing agent is circulated uniformly through the work load in the load chamber 16 by the operation of the hot fan 32.

On completion of the carburizing cycle, the workpieces are subjected to diffusion and then cooled to approximately 400° F. so that they can be removed into the outside atmosphere without oxidation. During diffusion, the pressure in the furnace chamber may be pumped down to a pressure of 0.2 to 30 torr absolute. During cooling, an inert gas backfill can be used backfilling to 700–800 torr. A gas such as nitrogen can be employed. The vacuum chamber is then opened and the workpieces removed.

Although not preferred, the carburizing gas can be put into the vacuum chamber before heating the workpiece. be In one operation, an integral oil quench vacuum furnace with a 24"×36"×18" high work space was used, the heating chamber door in this furnace being a thermal barrier but not vacuum tight. For this particular furnace, it was experimentally determined that a 300 torr absolute pressure (0.39 atmosphere or 5.84 pounds per square inch absolute) was necessary for the hot circulating fan to effectively circulate the carburizing gas, which was natural gas, throughout a standard load.

A round 1" diameter of 4" length standard test bar was used. The standard load employed was three 24"×36"×6" high baskets weighing 85 pounds each, which were placed on a 24"×36"×2" cast stainless steel grid weighing 70 pounds and loaded with 506 pounds net of the 1" diameter by 4" long test bars which gave an 831 pound gross load. The bars were 1018 steel and were racked in a checkerboard pattern of bars and open spaces on 1⅛" wire mesh with 1"×1" openings.

Twenty-seven of the test bars were labelled and systematically located in the baskets. Twenty-four bars were 1018 steel and three were 1045 steel. One of the 1018 bars and one of the 1045 bars from the center of each basket were designated for carbon gradient studies. The set from the middle basket was analyzed.

As is known, a carbon gradient is a plot or graph of the carbon content of the steel which shows how the carbon content varies as the depth beneath the surface increases. A carbon gradient is obtained by machining thin layers of material off the surface of a round bar and analyzing the amount of carbon in the shavings from each layer. After the shavings were analyzed, the data determined was as follows:

TABLE I

| 1700° F., 1.5 hours carburize, 300 torr/100 scfh natural gas flow, no diffusion | | | |
|---|---|---|---|
| DEPTH | ANALYSIS | DEPTH | ANALYSIS |
| .000"-.002" | 1.51% | .030"-.035" | 0.35% |
| .002"-.004" | 1.17% | .035"-.040" | 0.28% |
| .004"-.006" | 1.17% | .040"-.045" | 0.25% |
| .006"-.008" | 1.14% | .045"-.050" | 0.24% |
| .008"-.010" | 1.09% | .050"-.060" | 0.22% |
| .010"-.015" | 0.96% | .060"-.070" | 0.22% |
| .015"-.020" | 0.80% | .070"-.080" | 0.22% |
| .020"-.025" | 0.63% | .080"-.090" | 0.22% |
| .025"-.030" | 0.46% | .090"-.100" | 0.22% |

In each of the above analyses is plotted against the midpoint of the layer, the resulting points can be joined with a smooth curve. This smooth curve indicates the carbon content at any depth of interest. This has been done for the data above in FIG. 3. For example, referring to FIG. 3, one can see that while the data is actually known for 0.0175" (0.015"-0.020") as 0.80% and 0.0225" (0.020"-0.025") as 0.63%, the value for 0.020" can easily be read from the curve as 0.71%.

Again referring to FIG. 3, one can determine the "surface" carbon content by extrapolating the carbon gradient curve to zero depth. This gives 1.67% carbon in this example. A better number to use is the percent carbon at 0.001" or even at 0.005" to eliminate any surface effects. The 0.005" depth gives a better comparison with atmosphere carburized cases because from 0.005" into the core, the SAG carburized case has the same shape as the atmosphere cases. From the surface to 0.003"-0.005", the SAG carburized cases, particularly those with 0 diffusion time, show an almost linear peak due to their high surface potential. As the ratio of diffusion time to carburizing time increases, the surface peak blends into the plateau typical of carburized and diffused atmosphere carbon gradients, but without any decarburization at the surface.

Figure 3:
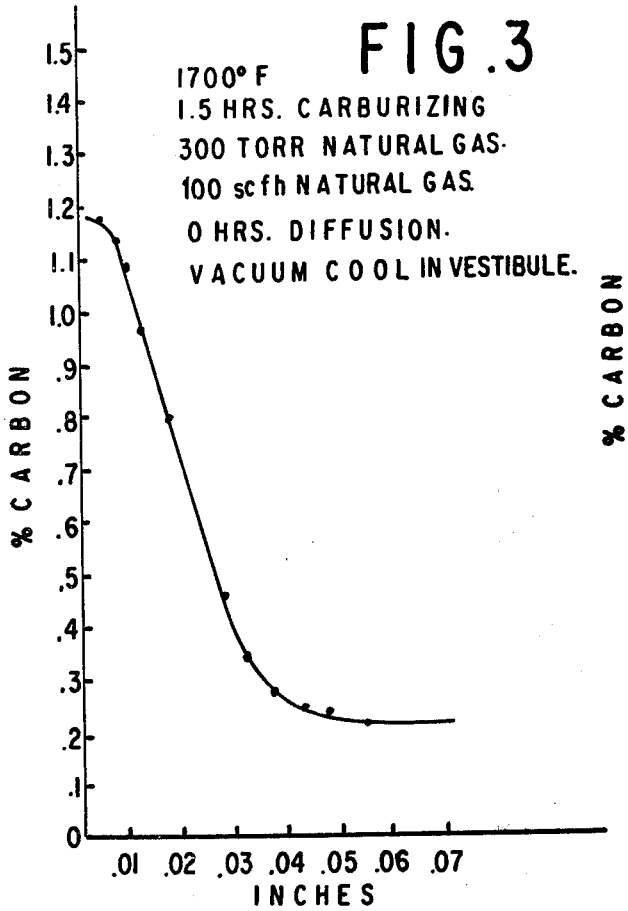
FIG. 3 is a graph showing % carbon and inches depth for the run of Table I.
Figure 4:
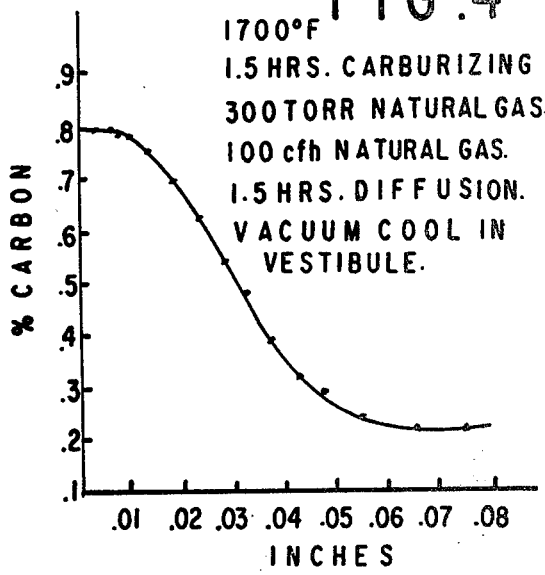
FIGS. 4 and 5 are graphs comparing % carbon and inches depth of runs similar to FIG. 3 and also including diffusion cycles.
Figure 5:
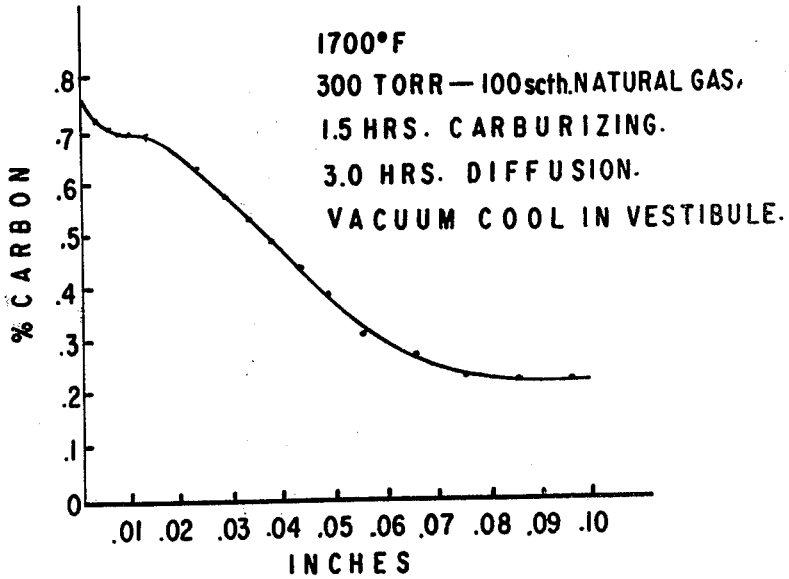
Figure 6:
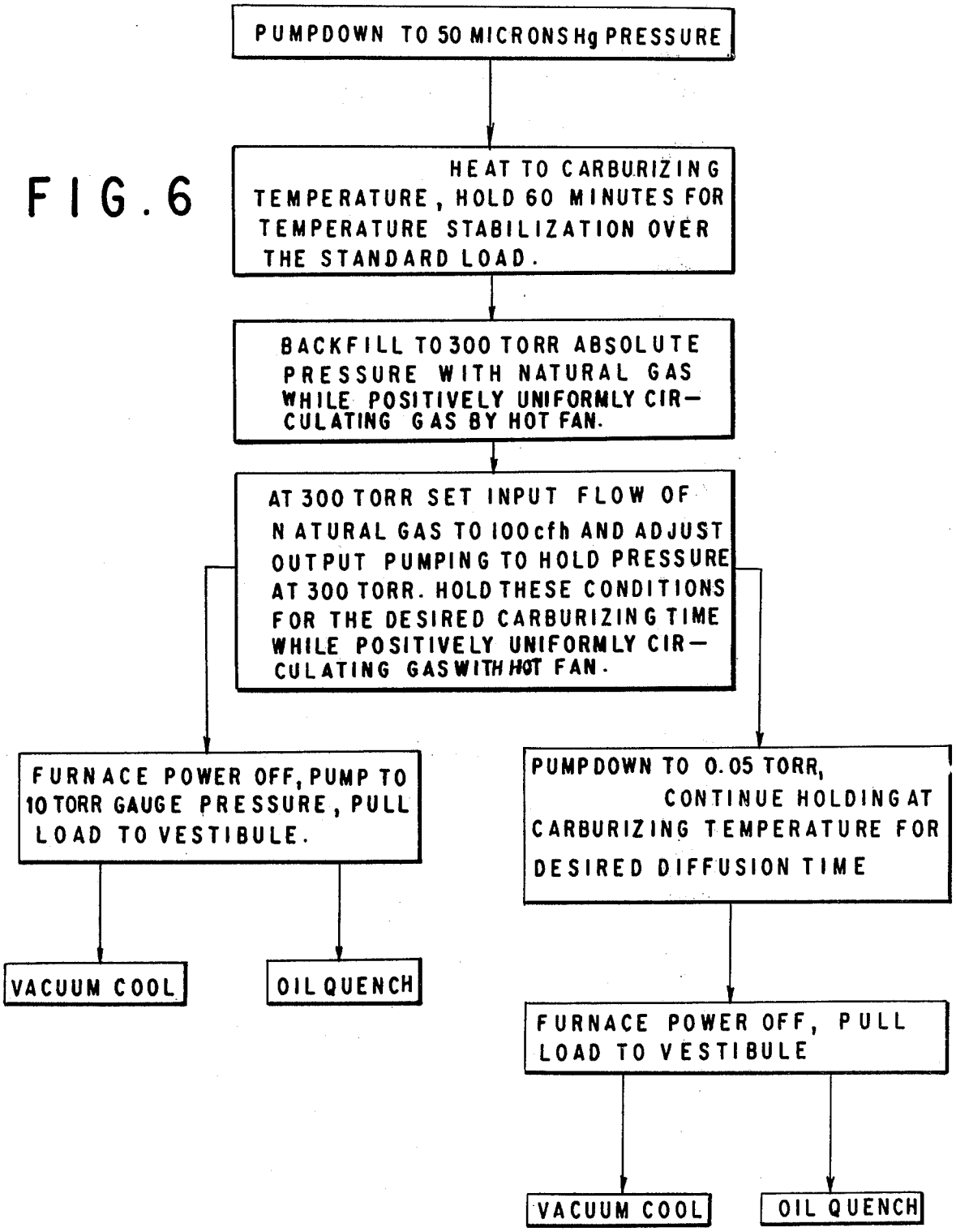
FIG. 6 is a process chart showing treatment procedures.

The carbon gradient also serves as the basis for several definitions of case depth. One definition of effective case depth is the distance from the surface to the 0.50% carbon level (50 points). Closely related to this definition is the 40 point definition; that is, the effective case depth is the distance from the surface to the 0.40% carbon level (40 points). Different industries use the different definitions. The total case is often defined as the distance from the surface to a carbon level that is 0.04% carbon (4 points) above the carbon level of the core of the bar. Alternatively, the total case depth is defined as the distance from the surface to the depth at which the carburized cycle has raised the carbon content above the core level. The data for FIGS. 3, 4 and 5 are tabulated below:

TABLE II

| FIGURE | CARBURIZING TIME | DIFFUSION TIME | SURFACE %C(.005") | EFFECTIVE CASE 0.50%C | EFFECTIVE CASE 0.40%C | TOTAL CASE +.04%C | TOTAL CASE CORE |
|---|---|---|---|---|---|---|---|
| 3 | 1.5 HRS. | 0 HRS. | 1.17 | .026" | .030" | .040" | .055" |
| 4 | 1.5 HRS. | 1.5 HRS. | 0.80 | .030" | .037" | .051" | .065" |
| 5 | 1.5 HRS. | 3.0 HRS. | 0.71 | .036" | .048" | .066" | .085 |

Preliminary processing determined that carburizing can be accomplished at pressures down to 10 torr and by only adding natural gas or by flowing natural gas through the furnace up to 100 cubic feet per hour. Temperatures from 1500° F. to 1900° F. were investigated as was carbonitriding (the addition of ammonia and natural gas).

In order to match the loading density of the best atmosphere batch carburizing furnaces under conditions now prevalent in industry, carburizing at 1700° F. and 300 torr pressure with 100 cubic feet per hour natural gas flow through the furnace has proven very satisfactory. Most of the cycles processed were preheated, carburized, diffused and vacuum cooled. Vacuum cooled bars are soft enough to allow machining for carbon gradient analysis without further processing and result in an easily analyzed microstructure without quenching effects.

Having matched the loading density of an atmosphere furnace, the vacuum furnace surpasses it in productivity by carburizing faster. How much faster is illustrated in Table III hereafter.

TABLE III

| | 0.05%C | 0.40%C | CORE +.04%C | CORE |
|---|---|---|---|---|
| 1700° F. Endothermic Atmosphere | .015 | .019 | .033 | .037 |
| 1700° F. Vacuum | .026 | .030 | .040 | .055 |
| 1900° F. Vacuum | .044 | .051 | .061 | .075 |

All of the cycles in Table III are for 1.5 hours carburizing with no diffusion. This gives the maximum advantage to the SAG processing since the process is taking place at the highest carbon potential (1.50%-1.60% carbon). Another standard of comparison is the Harris value taken from the standard atmosphere carburizing curves. For 1.5 hours at 1700° F., Harris gives 0.031". At the same temperature, SAG carburizing raises the 1018 steel to 0.39% carbon at this depth and gives a (Base +0.04%C.) total case depth of 0.040". This is a 29% increase. If the total case is taken as the maximum depth to which the core carbon is modified, the carbon gradient gives 0.050" or a 77% increases over the Harris value. It has been shown by Harris and others that going from 1700° F. to 1900° F. doubles the case depth. Going from 1700° F. to 1900° F. in SAG carburizing gives only a 36% increase over SAG carburizing at 1700° F.; however, this represents a 142% increase over Harris at 1700° F.

More carbon is added by SAG carburizing in the same time at the same temperature. During the diffusion cycle in SAG carburizing, all of this carbon will be diffused deeper into the steel surface. The atmosphere diffusion cycle both moves carbon deeper and pulls carbon out of the surface. Thus, atmosphere carburizing tends to work against itself during the diffusion cycle.

Carbonitriding and nitriding also can be carried out using the principles of the invention as described in the foregoing. The hot fan preferably is at the end as shown in FIG. 1 but could be other appropriate places, such as at the top, sides or bottom.

It is apparent that the present invention has disclosed an effective system for the uniform SAG carburizing, carbonitriding or nitriding of workpieces. The presence of the hot fan at one end of the load chamber permits the uniform circulation of the carburizing or treating material or gas through the workpieces constituting the load.

It will be understood that changes in various details of construction and arrangement of parts and steps of the process may be made without departing from the spirit of the invention except as defined in the appended claims.

What is claimed is:

1. The method of subatmospheric gaseous carburizing or carbonitriding workpieces in a load chamber within a vacuum furnace comprising the steps of placing a load of the workpieces to be carburized in the load chamber, sealing said furnace and evacuating said chamber to a first subatmosphric pressure for removing most of the air and adsorbed gases and surface contaminants from the workpieces, then bringing said workpieces up to treatment temperature in the range of 1500° F. to 1900° F., holding said workpieces for a sufficient time period at said treatment temperature and at said first subatmospheric pressure for temperature stabilization throughout the load, back filling carburizing gaseous treatment material into said furnace until the pressure in said chamber has been raised to a second subatmospheric pressure greater than said first subatmospheric pressure while maintaining said treatment temperature within said chamber, said treatment temperature being that temperature within the range of 1500° F. to 1900° F. at which the carburizing gaseous treatment material will carburize the workpieces, positively uniformly circulating said gaseous treatment material through the load of workpieces in the load chamber by a hot circulating fan within said furnace, said second subatmospheric pressure being at least 300 torr absolute for enabling the hot circulating fan to effectively circulate said gaseous treatment material in said furnace throughout said load of workpieces in said load chamber, at said second subatmospheric pressure providing an input flow of the gaseous treatment material into said furnace at a predetermined constant flow rate and adjusting the output pumping from said furnace for holding the pressure in said chamber at said second subatmospheric pressure which is at least 300 torr absolute, continuously circulating the gaseous treatment material through the load by the hot circulating fan, and continuing for the desired carburizing time said treatment temperature, said input flow, said output pumping, and said uniform circulating by the hot circulating fan.

2. The method of subatmospheric gaseous carburizing or carbonitriding as claimed in claim 1, including the further step of stopping said input flow and hot fan circulating, pumping down to a lower subatmospheric pressure for allowing diffusion of the carbon in the carburized case of the workpieces to move deeper into the workpieces and holding at said treatment temperature for the desired diffusion of time.

3. The method of subatmospheric gaseous carburizing or carbonitriding as claimed in claim 2, including the further step of cooling the workpieces after said treatment steps to approximately 400° F. before exposure to the atmosphere outside of the furnace.

4. The method of subatmospheric gaseous carburizing or carbonitriding as claimed in claim 1, wherein said first subatmospheric pressure is at the pressure level of approximately 0.050 to 0.1 torr.

5. The method of subatmospheric gaseous carburizing or carbonitriding as claimed in claim 1, wherein said second subatmospheric pressure of at least 300 torr provides sufficient partial pressure of the carburizing gaseous treatment material to supply the unreacted source of carbon to the surfaces of the workpieces where adsorption of the unreacted source of carbon onto the surfaces of the workpieces and effective absorption of carbon into the surface of the article can be maintained.

6. The method of subatmospheric gaseous carburizing or carbonitriding as claimed in claim 2, wherein said lower subatmospheric pressure for diffusing of carbon into the workpieces is at the pressure level of 0.2 to 30 torr.

7. The method of subatmospheric gaseous carburizing or carbonitriding as claimed in claim 1, whrein said carburizing gaseous treatment material is natural gas and said predetermined constant flow rate is 100 standard cubic feet per hour.

8. The method of subatmospheric gaseous carburizing or carbonitriding as claimed in claim 1, wherein said carburizing gaseous treatment material is natural gas which is primarily methane with up to 1% oxygen, up to 2% carbon dioxide, and up to 15% higher hydrocarbons.

9. The method of subatmospheric gaseous carburizing or carbonitriding as claimed in claim 3, including the further step of back filling the furnace with an inert gas during cooling to bring the pressure in the load chamber to 700–800 torr.

10. The method of subatmospheric gaseous carburizing or carbonitriding as claimed in claim 2, in which said lower subatmospheric pressure at which said diffusion occurs is the same as the first subatmospheric pressure at which said temperature stabilization occurs.

11. The method of subatmospheric gaseous carburizing or carbonitriding workpieces in a load chamber within a vacuum furnace comprising the steps of placing a load of the workpieces to be carburized in the load chamber, sealing said furnace and evacuating said chamber to a first subatmospheric pressure of from 0.2 to 30 torr for removing most of the air and adsorbed gases and surface contaminants from the workpieces, then bringing said workpieces up to treatment in temperature in the range from 1500° F. to 1900° F., holding said workpieces for a predetermined time period at said treatment temperature for temperature stabilization throughout the load, back filling carburizing gaseous treatment material into said furnace until the pressure in said chamber has been raised to a second subatmospheric pressure of from 300 to 500 torr while maintaining said treatment temperature within said chamber, said treatment temperature being that at which the carburizing gaseous treatment material will carburize the workpieces, positively uniformly circulating said gaseous treatment material through the load of workpieces in the load chamber by a hot circulating fan within said furnace, said second subatmospheric pressure being sufficient for the hot circulating fan to effectively circulate said gaseous treatment material in said furnace through said load of workpieces in said load chamber, at said second subatmospheric pressure providing an input flow of the gaseous treatment material into said furnace at a predetermined constant flow rate and adjusting the output pumping from said furnace for holding the pressure in said chamber at said second subatmospheric pressure, continuously circulating the gaseous treatment material through the load by the hot circulating fan, and continuing for the desired carburizing time said treatment temperature, said input flow, said output pumping, and said uniform circulating.

* * * * *

UNITED STATES PATENT OFFICE

CERTIFICATE OF CORRECTION

Patent No. 4,160,680 Dated July 10, 1979

Inventor(s) Russell F. Novy, Gerald L. Scott and Thomas O. Zurfluh

It is certified that error appears in the above-identified patent and that said Letters Patent are hereby corrected as shown below:

Column 2, lines 20 and 21, "minimun" should read -- minimum --;

line 55, "with" should read -- without -- .

Column 6, line 33, after the period (.), "be" should be cancelled.

Column 7, line 14, "In" should read -- If -- .

Column 8, line 38, "increases" should read -- increase -- .

Column 10, line 41, "in" should be cancelled.

Signed and Sealed this

*Third* Day of *June 1980*

[SEAL]

*Attest:*

SIDNEY A. DIAMOND

*Attesting Officer* *Commissioner of Patents and Trademarks*